US006574995B2

(12) United States Patent
Sauter et al.

(10) Patent No.: US 6,574,995 B2
(45) Date of Patent: Jun. 10, 2003

(54) LATCH NEEDLE COMPRISING A RELIEVED LATCH SHANK

(75) Inventors: Manfred Sauter, Stetten (DE); Karl-Heinz Mattes, West Brome (CA)

(73) Assignee: Groz-Beckert AG, Albstadt (DE)

( * ) Notice: Subject to any disclaimer, the term of this patent is extended or adjusted under 35 U.S.C. 154(b) by 0 days.

(21) Appl. No.: 10/089,408

(22) PCT Filed: Jul. 18, 2001

(86) PCT No.: PCT/DE01/02626

§ 371 (c)(1),
(2), (4) Date: Apr. 1, 2002

(87) PCT Pub. No.: WO02/08506

PCT Pub. Date: Jan. 31, 2002

(65) Prior Publication Data

US 2002/0152774 A1 Oct. 24, 2002

(30) Foreign Application Priority Data

Jul. 22, 2000 (DE) ..... 100 35 827

(51) Int. Cl.[7] ..... D04B 35/04
(52) U.S. Cl. ..... 66/121
(58) Field of Search ..... 66/121, 122, 116, 66/123

(56) References Cited

U.S. PATENT DOCUMENTS

| | | | | |
|---|---|---|---|---|
| 1,039,450 A | | 9/1912 | Scott | |
| 1,991,140 A | | 2/1935 | Currier | |
| 5,509,280 A | * | 4/1996 | Schuler et al. | 66/121 |

FOREIGN PATENT DOCUMENTS

| | | |
|---|---|---|
| DE | 1 113 537 | 10/1967 |
| DE | 39 00 162 | 3/1990 |
| DE | 44 02 706 | 6/1995 |
| EP | 0 077 022 | 4/1983 |

* cited by examiner

*Primary Examiner*—Danny Worrell
(74) *Attorney, Agent, or Firm*—Venable; Norman N. Kunitz

(57) ABSTRACT

The improved latch needle (1) is provided with a latch (5) having a latch shaft (11) with side surfaces (21, 22), which are divided into surface areas (23, 24) that are offset against each other and/or are arranged at an angle to each other. As a result, the thickness of latch (5) measured in the direction of its rotational axis (27) is slightly larger than the thickness in the shaft region (43), particularly at a location (45) in the area of transition from the latch shaft (11) to the latch spoon (16). On the other hand, the location (43) is close to the hook-side opening of the latch slot (6). By reducing the width, particularly in this region, the easy movement of latch (5) is ensured even if dust or dirt enter the latch slot (6) or are deposited on the side surfaces (21, 22).

11 Claims, 6 Drawing Sheets

LATCH NEEDLE COMPRISING A RELIEVED LATCH SHANK

BACKGROUND OF THE INVENTION

The invention relates to a latch needle, in, particular for knitting machines.

Latch needles are used for different types of knitting machines. A latch needle is known, for example, from German Printed Patent Specification 1113537. This latch needle has a needle body with a hook formed onto the end. A latch is positioned pivoting inside a latch slot formed near the hook. With its free end, the so-called latch spoon, the latch can rest on the hook tip and thus close off the trapping clearance. From this closed position, the latch can pivot back to the upright position, in which the trapping clearance is freed. The pivoting movement should be as easy as possible. Modern knitting machines frequently require needles that move easily. Hard to move needles knit unevenly and thus produce a poor loop picture.

The latches of some machines must fall back into the upright position as a result of their own weight. If this does not happen reliably, the danger exists that the latches come in contact with parts of the machine, e.g. the yarn-feed apron, and are bent as a result.

The easy movement of the latch can be achieved by increasing the latch play. However, increasing the latch play worsens the latch guidance even if the needle is still new. With a further increase in wear, the latch guidance becomes less and less precise, thus reducing the operational reliability.

Another problem resulting from increased latch play occurs if the latch is positioned with rivets pressed out of the slot cheeks, as disclosed in U.S. Pat. No. 1,991,140. For the positioning, the latch provided with a bearing opening is inserted into the latch slot. Following this, sections of the slot cheeks are pressed or punched toward the inside with the aid of two plunging tools (engravers), such that these cheek portions enter the bearing opening in the latch and form a bearing rivet for the latch. This operation requires relatively little latch play. The latch forms a counter stop for the pressing or punching operation, particularly with the region surrounding the bearing opening. If the latch is noticeably smaller than the latch slot, the slot cheeks are bent toward the inside during the punching operation, thus preventing the latch needle from being produced with the desired quality.

SUMMARY OF THE INVENTION

Starting with this premise, it is the object of the invention to provide a latch needle with a latch that is designed to move easily and is precisely guided.

This object is solved with a latch needle having features in accordance with the present invention.

The latch needle according to the invention has a latch comprising a latch spoon and a latch shaft, the side surface or surfaces of which are divided. A first surface area surrounds the bearing opening where it ensures a slight latch play on the side. The following second surface area permits a greater latch play, meaning the distance to the neighboring slot cheek is increased, thus reducing contact with the wall to small surface areas or omitting it completely. As a result, it is possible to produce latch needles with latches that move extremely easily. For this, the surface area surrounding the bearing opening can be designed such that the latch is guided with little play and thus very precisely. On the other hand, the following second surface area can be set back, thus reducing the thickness of the latch shaft by a few $1000^{th}$ millimeters (for example 0.03 mm). During the opening and closing of the latch, meaning the pivoting movement between closed position and upright position, the second surface area that extends along the latch shaft is thus prevented from being wedged into the slot or from experiencing strong friction inside the slot. The set back surface area contributes only slightly or not at all to the side guidance of the latch. A functional separation between the surface areas exists. The first surface area surrounding the latch opening primarily is responsible for the side guidance of the latch. This can possibly be recognized by the fact that the side play of the latch is respectively the same in the closed position or the upright position and an in an intermediate position. Having little latch play in the area of the rivet ensures a good guidance of the latch inside the slot.

The insignificant latch play inside the slot in the region of the guide surface of the first surface area considerably facilitates the process of pressing out the rivet, meaning the pressing or punching operation during which sections of the cheek wall are pressed into the bearing opening of the latch. The insignificant play prevents the cheek walls from being squeezed together when punching out the rivets and thus deforming the needle. Especially precise needles can be produced as a result.

On the other hand, the increased play between latch shaft and cheek wall reduces the danger of threads being wedged in, damaged or cut between latch and cheek (slot sidewall). In addition, it also reduces the danger that fibers or dirt will enter the slot and result in a jamming of the latch.

Owing to the fact that the latch guidance is essentially assumed by the surface areas surrounding the latch, a noticeably larger spacing can exist between the remaining latch flanks of the latch shaft and the slot cheeks. The difference between the thickness of the latch shaft in the region of the latch hole and in the region of the latch head or latch spoon can amount to several one-hundredth millimeters, without this worsening the latch guidance.

Despite the improvement in the easy movement of the latch, the latch is guided with such precision that the latch makes even better contact with the hook. As a result of the increased precision during the operation of the needle, the wear between latch and hook can be reduced. In addition, the latch shaft does not make frictional contact over its complete length that is submerged in the slot, but only in the bearing region on the slot cheek.

Both side surfaces of the latch shaft for the latch needle are preferably designed identical, so that both side surfaces are divided into separate surface areas. The latch in that case is designed to be symmetrical to a center plane.

A line-shaped or strip-shaped separation or transition area is formed between the two separate surface areas. In other words, the separation area, for example, takes the shape of a line, an edge or a step or forms a slightly curved transition area. The separation area of one preferred embodiment is a step, which results in a large distance between cheek and surface area along the area recessed by the step. The surface area can be planar or can be curved in one or several directions or can be structured. The same is true for the other surface area surrounding the bearing opening, which can also be planar or otherwise formed.

BRIEF DESCRIPTION OF THE DRAWINGS

Additional advantageous details of embodiments of the invention follow from the description below and the drawings.

The drawing shows exemplary embodiments of the invention, which show in.

DESCRIPTION OF THE PREFERRED EMBODIMENTS

Figure 1:
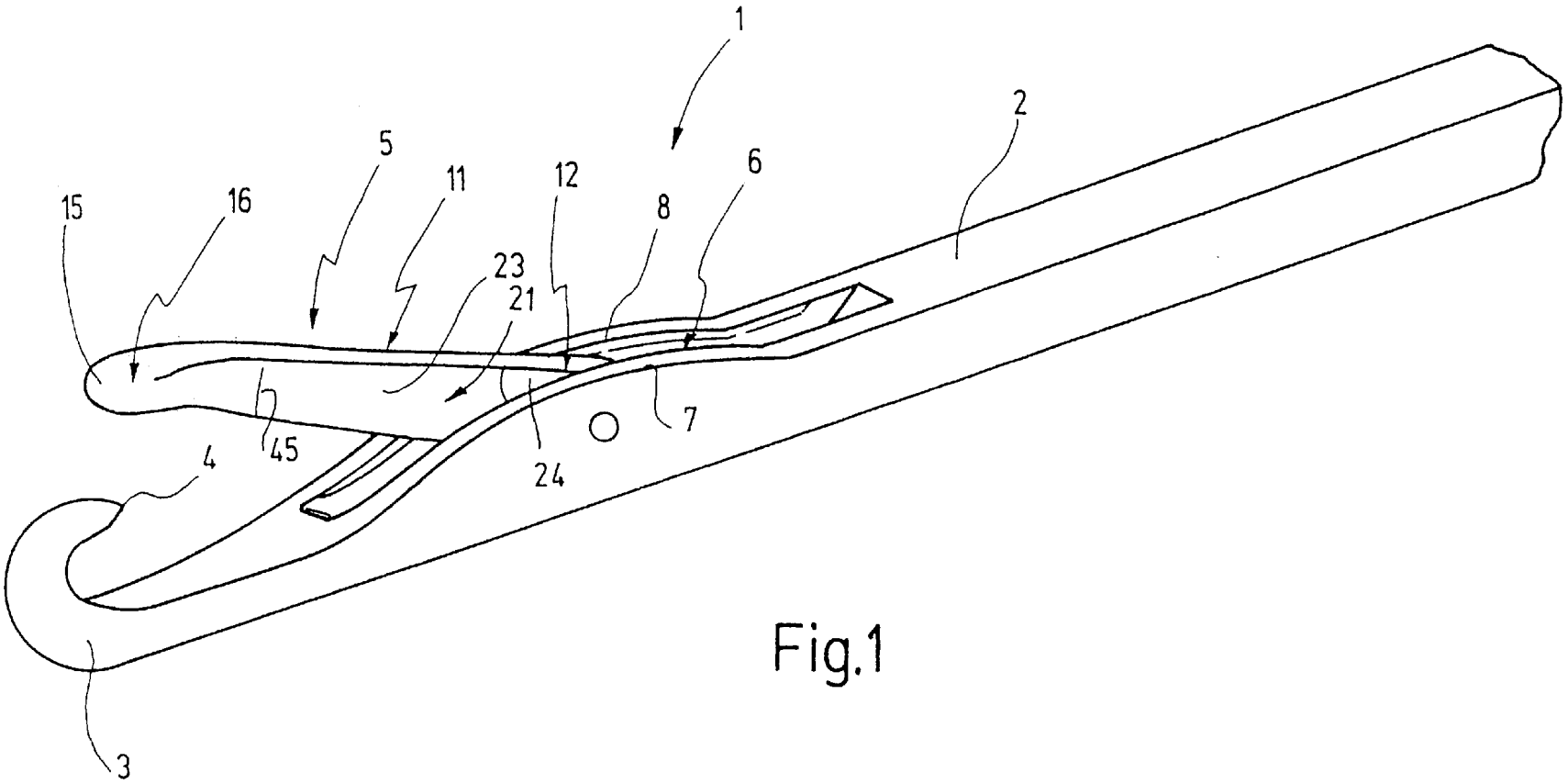
FIG. 1 Details of a latch needle, shown as perspective and schematic representation.

FIG. 1 shows a basic diagram of a latch needle 1. The latch needle 1 has a needle body 2 with a hook 3 formed onto its free end. This hook ends in a hook tip 4, which functions as counter stop and support for a latch 5 that is positioned pivoting on the needle body 2. A latch slot 6 that is delimited by two cheeks 7, 8 is formed into the needle body 2 for accommodating the latch 5. The cheeks 7, 8 are respectively level and are arranged parallel to each other.

Figure 2:
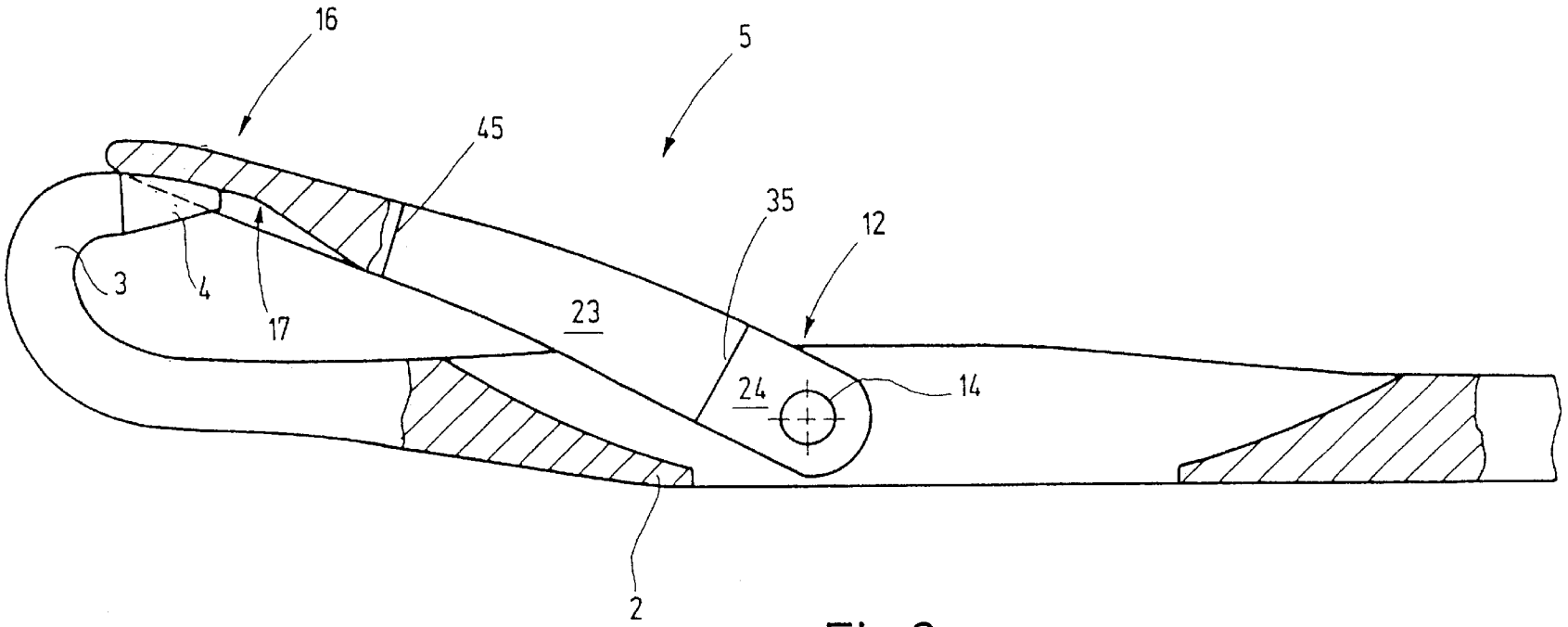
FIG. 2 The latch needle according to FIG. 1, showing details in a partial sectional view from the side.

The latch 5 has a latch shaft 11, which projects with one end 12 into the latch slot 6. FIG. 2 in particular shows that the end 12 is provided with a latch opening 14 for positioning the latch 5. In a region 45 at the opposite end 15, the latch shaft 11 changes over to a latch spoon 16, which is provided on the hook side with a recess 17 (noucat).

Figure 3:
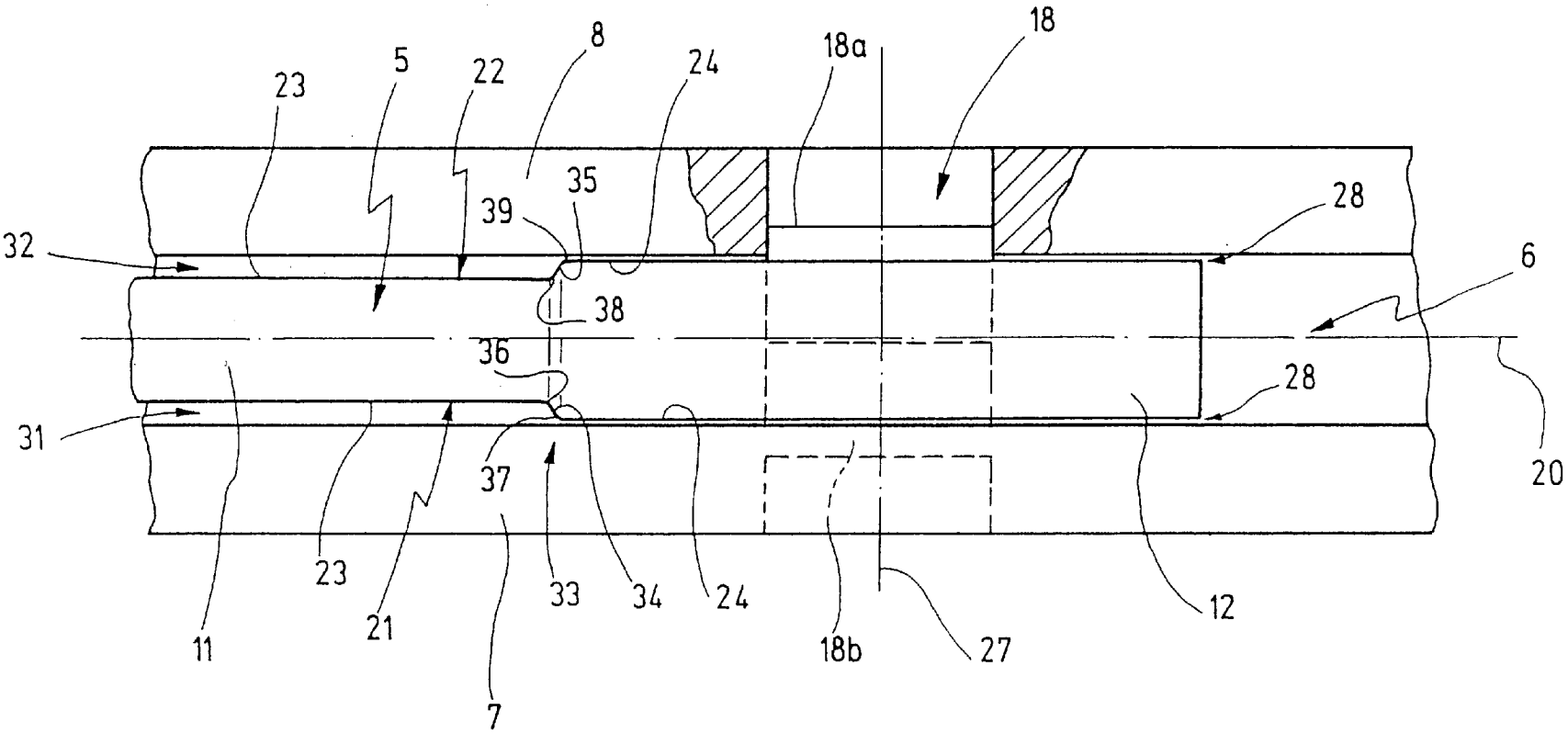
FIG. 3 The latch needle according to FIGS. 1 and 2, showing details in a partial sectional view from the top and on a different scale.

A rivet 18, consisting of two rivet halves 18*a*, 18*b*, function to position the latch 5 pivoting inside the latch slot 6. FIG. 3 shows that these rivet halves are formed by pressing or punching wall sections out of the cheeks 7, 8 and into the latch opening 14.

The first embodiment of latch 5 is shown in FIG. 3. This embodiment has two side surfaces 21, 22 that extend over the two opposite-arranged flanks of the latch shaft 11 from its end 12 to the location 45. The side surfaces 21, 22 are formed mirror-symmetrical to a longitudinal center plane 20, indicated with dash-dot line in FIG. 3. This is true at least for the preferred embodiment and otherwise also applies to the remaining latch 5 and latch needle 1. The following description of the side surface 21 therefore also applies to the side surface 22.

The side surface 21, in the same way as the side surface 22, is divided into two surface areas 23, 24. The second surface area 23 extends starting with the latch spoon 16 in the direction of latch opening 14 without reaching it. The surface area 23 can be a level surface. Alternatively, this surface area can also be curved in some sections, for example bent around a center axis of latch 5 or can be rounded at its edges and in the end areas 25, 26 (FIG. 4).

The first surface area 24 can surround the latch opening 14 and can thus be ring-shaped. The surface area 24 can also have a level design for this. If necessary, the shape of the surface area 24 can also be interrupted, for example by indentations or indentations that extend in radial direction away from the latch opening 14, or the like. Whereas the surface areas 24 of both side surfaces 21, 22 are preferably oriented parallel to each other (FIG. 3), this is not absolutely necessary for the surface areas 23. However, the embodiment according to FIG. 3 at least approximates this design, wherein the surface areas 23 are spaced apart by a distance that is less by several $1000^{th}$ millimeter than the distance between the surface areas 24. The end 12 of latch 5 thus forms a bearing device with the rivet 18 and the respective insides of the cheeks 7, 8. This bearing device positions the latch 5 with little play on the side, such that it can pivot around its rotational axis 27, which simultaneously functions as center axis for the rivet 18. The side (axial) play of latch 5 is illustrated in FIG. 3 respectively with a gap 28, 29. This gap 28, 29 is smaller by several $1000^{th}$ millimeter than a comparably larger gap 31, 21 that is specified between the cheek 7, 8 and the respective surface area 23. While the gaps 28, 29 are preferably parallel gaps, the gaps 31, 32 can be either parallel gaps or wedge-shaped gaps and can expand in the direction of latch spoon 16. In that case, they reach the greatest width in the area 45 at the end 15 of the latch shaft 11, at the transition to the latch spoon 16.

Figure 4:
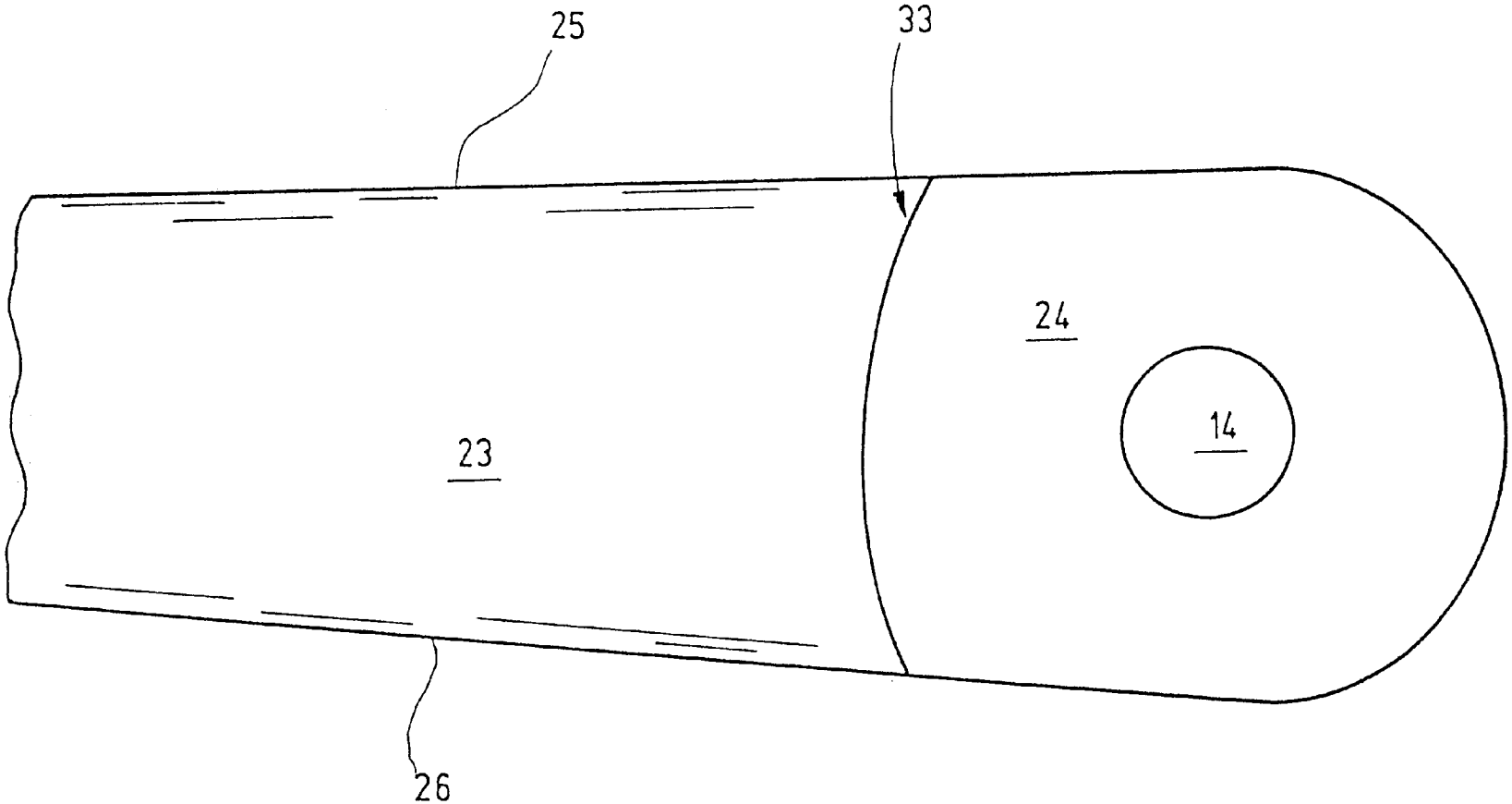
FIG. 4 The latch for the latch needle according to FIGS. 1 to 3, showing a first embodiment in a view from the side.

The illustration in FIG. 4 shows that a separation area 33 is formed between the surfaces areas 23, 24, which is approximately line-shaped in this view from the side. FIG. 3 shows the area of separation in the form of a step 34, 35 having edges 36, 37, 38, 39, which can be slightly rounded if necessary. The step 34, 35 are only a few $1000^{th}$ to a few $100^{th}$ millimeters high but is nevertheless visible with the naked eye.

FIG. 4 illustrates that the step 35 can be curved around the latch opening 14. If necessary, the step 35 can also be arranged along a straight line, as shown in FIG. 2. FIG. 3 shows that the step 35, 36 can have a relatively steep design. If necessary, the step can also be formed by a ramp-like or embankment-type region, which creates a gradual transition between the surface areas 23, 24.

Figure 5:
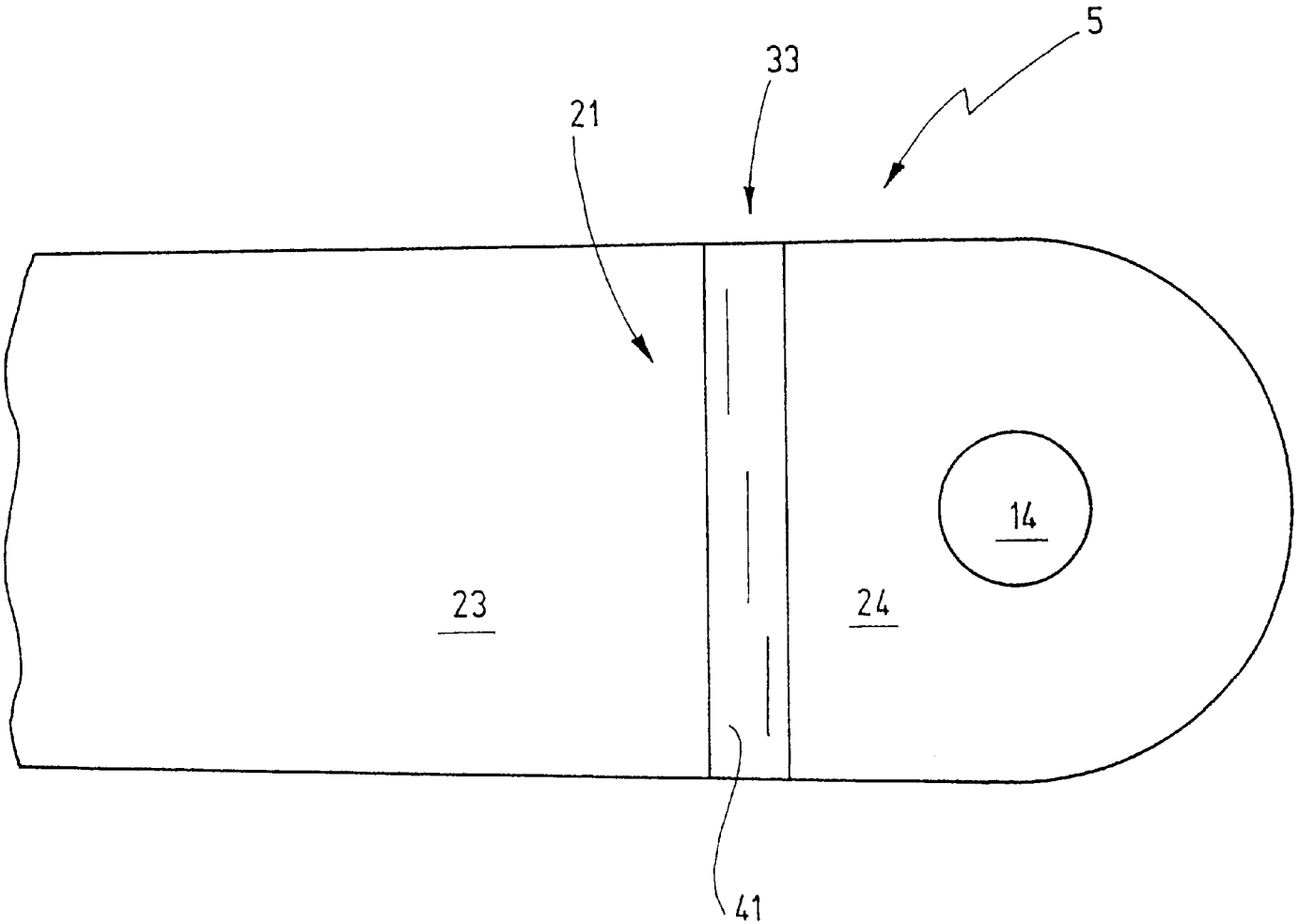
FIG. 5 A modified embodiment of a latch for the latch needle in FIGS. 1 to 3, shown in a view from the side.

A modified embodiment of latch 5 is shown in FIG. 5. The difference is in the separation area 33. Whereas this area was respectively designed as step 35 in the above-described embodiments, thus forming a z-shaped or s-shaped curved area in a view from above, the separation area 33 for the embodiment according to FIG. 5 is formed by a simple curved (arched) edge region 41. This region separates and connects the surface areas 23, 24 and is visible on the side surface 21 or 22 as an edge. If the edge area 41 is somewhat rounded, as indicated in FIG. 5, it may not be visible immediately with the naked eye. Once it makes contact with the surface areas 23, 24, it can be observed in the microscope or measured with other means.

The latch needle 1 described so far shows improved knitting behavior.

Figure 6:
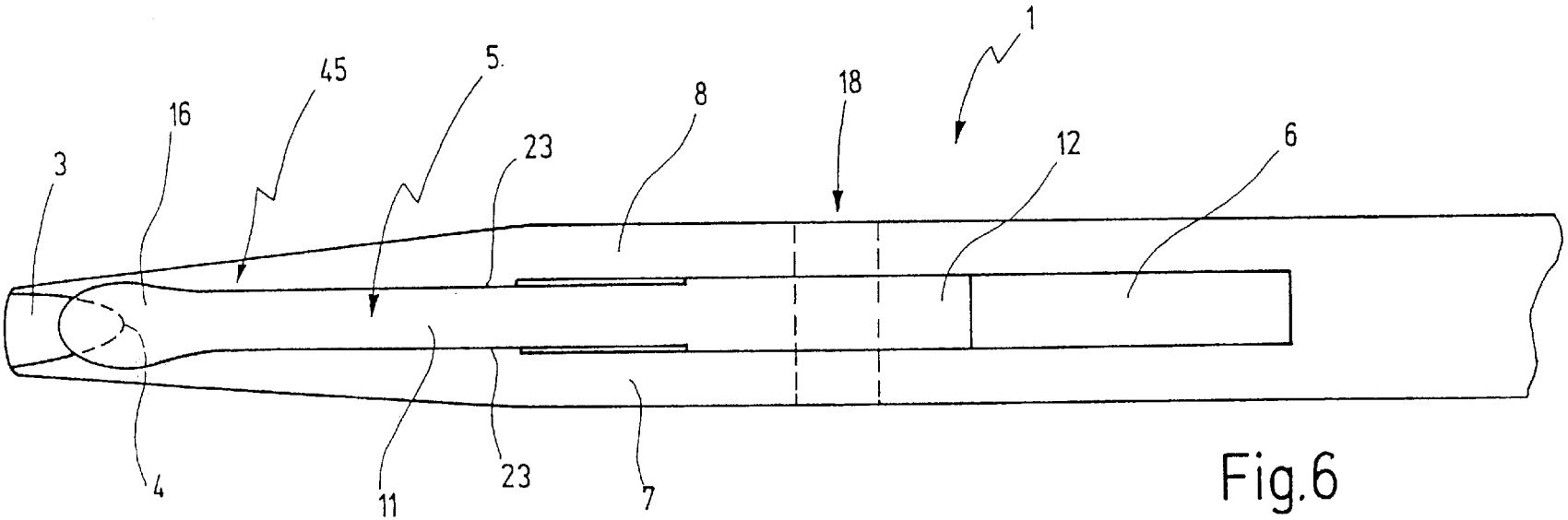
FIG. 6 A view from above of the latch needle shown in FIGS. 1 to 3, with the latch in the central closing position.

FIG. 6 illustrates that the latch 5 of latch needle 1 is guided with its end 12 inside the latch slot 6 and is positioned with the rivet 18. The latch shaft 11 extends freely inside the latch slot 6 and, in the ideal case, does not make contact with the cheeks 7, 8. At its end 12, the latch 5 is guided with such precision that the latch spoon 16 hits the hook 3 or the hook tip 4 with little center deviation. The precise guidance of the latch represents a wear reserve, meaning that even if the latch play on the side increases with increasing wear, it remains within permissible tolerances.

Figure 7:
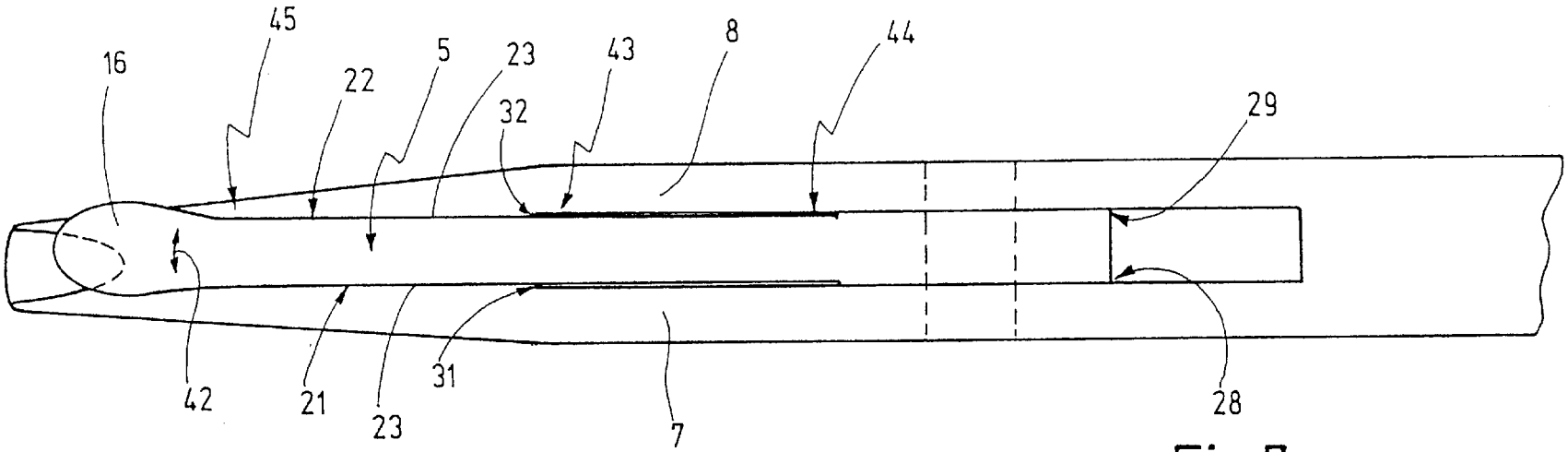
FIG. 7 A schematic view from above of the latch needle according to FIG. 6, with the latch in the closed position and deflected to the side.

The end 12 of latch 5 has a specific, slight play inside the latch slot 6. As a result, the latch 5 can be deflected slightly to the side, as shown with arrow 42 in FIG. 7. The gap 31, 32 in that case prevents that the respective side surface 21, 22 or the respective surface area 23 makes contact with its complete surface with the cheek 7, 8. In the final analysis, this is achieved by designing the gap 31, 32 to be larger than the respective gap 28, 29. The surface areas 23 at most contact the cheeks 7, 8 in some sections or points. For the exemplary embodiment shown in FIG. 7, the surface area 23 and the cheek 8 come only in contact only in one frontal location 43 for deflecting the latch 5 to one side (in FIG. 7 toward the top). The spacing between the surface area 23 and the cheek 8 is preserved at a distance thereto at location 44. It can also be achieved that the surface are 23 does not make contact with the cheeks 7, 8.

The design of side surfaces 21, 22 of latch shaft 11 for latch 5, presented herein, permits an easy movement and precise positioning of latch 5 inside the latch slot 6. The latch 5 moves easily even during actual operations, meaning if fiber residues or dust enter the latch slot 6.

The improved latch needle 1 has a latch 5 with a latch shaft 11, the side surfaces 21, 22 of which are divided into the surface areas 23, 24 that are arranged offset and/or at an angle to each other. As a result, the latch 5 has a thickness, measured in the direction of its rotational axis 27, which is somewhat greater than in the shaft region (43), particularly at a location 45 of the transitional area between latch 11 and latch spoon 16. The location 43, on the other hand, is positioned approximately at the hook-side opening of the latch slot 6. By reducing the width, especially in this region, the easy movement of latch 5 is ensured even if dust or dirt enter the latch slot 6 or are deposited on the side surfaces 21, 22.

What is claimed is:

1. A latch needle comprising:

a needle body having a latch slot delimited by two opposite arranged cheeks;

a latch having a latch shaft that at least partially extends inside the latch slot and that has two side surfaces and a latch opening; and a bearing device extending through said latch opening for pivoting the latch inside the latch slot, wherein at least one of the side surfaces is divided into first and second separate surface areas, said first surface area being located adjacent the latch opening and said second surface area extending along the latch shaft away from the latch opening, wherein a first distance between the side surfaces at a first location removed from the bearing device is less than a second distance at a second location adjacent to the latch opening, and wherein said first surface area of said at least one of the side surfaces extends along the needle shaft to form a guiding surface to bear against at least one of said cheeks to substantially prevent play of the needle.

2. A latch needle according to claim 1, wherein each of said side surfaces of the latch shaft of the latch needle are divided into said separate surface areas.

3. A latch needle according to claim 1, wherein a strip forms a separation area between the surface areas.

4. A latch needle according to claim 3, wherein the separation area extends crosswise over the side surfaces.

5. A latch needle according to claim 1, wherein a step separates said surface areas.

6. A latch needle according to claim 1, wherein an edge area forms a separation area between said surface areas.

7. A latch needle according to claim 6, wherein the edge area is rounded.

8. A latch needle according to claim 1, wherein a visible edge forms a separation area between the surface areas.

9. A latch needle according to claim 3, wherein the separation area is straight.

10. A latch needle according to claim 3, wherein the separation area is curved.

11. A latch needle according to claim 1, wherein said guiding surface extends at a length along said needle shaft sufficient to substantially prevent said needle from pivoting at said bearing about a line perpendicular to a central axis of said bearing device and perpendicular to a central axis of the needle slot.

* * * * *

UNITED STATES PATENT AND TRADEMARK OFFICE

CERTIFICATE OF CORRECTION

PATENT NO. : 6,574,995 B2
DATED : June 10, 2003
INVENTOR(S) : Manfred Sauter et al.

It is certified that error appears in the above-identified patent and that said Letters Patent is hereby corrected as shown below:

Title page,
Item [73], Assignee, delete "AG" and insert -- KG --.

Signed and Sealed this

Fourth Day of November, 2003

JAMES E. ROGAN
*Director of the United States Patent and Trademark Office*